US011084285B2

(12) United States Patent
Mizuno

(10) Patent No.: US 11,084,285 B2
(45) Date of Patent: Aug. 10, 2021

(54) LIQUID DISCHARGE HEAD

(71) Applicant: BROTHER KOGYO KABUSHIKI KAISHA, Nagoya (JP)

(72) Inventor: Taisuke Mizuno, Yokkaichi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/585,361

(22) Filed: Sep. 27, 2019

(65) Prior Publication Data

US 2020/0171822 A1 Jun. 4, 2020

(30) Foreign Application Priority Data

Nov. 29, 2018 (JP) ..... JP2018-223994

(51) Int. Cl.
*B41J 2/14* (2006.01)

(52) U.S. Cl.
CPC .... *B41J 2/1433* (2013.01); *B41J 2002/14419* (2013.01)

(58) Field of Classification Search
None
See application file for complete search history.

(56) References Cited

U.S. PATENT DOCUMENTS

2003/0156164 A1* 8/2003 Sakaida ..... B41J 2/14209 347/68
2007/0252860 A1* 11/2007 Nitta ..... B41J 2/17596 347/14
2013/0208059 A1* 8/2013 Arimoto ..... B41J 2/14233 347/85
2016/0288498 A1* 10/2016 Hayashi ..... B41J 2/14233

FOREIGN PATENT DOCUMENTS

WO WO 2016/193749 A1 12/2016

* cited by examiner

*Primary Examiner* — Erica S Lin
(74) *Attorney, Agent, or Firm* — Scully, Scott, Murphy & Presser, P.C.

(57) ABSTRACT

A liquid discharge head includes: a pressure chamber; a nozzle connected to the pressure chamber and overlapping in a first direction with the pressure chamber; a first throttle channel connected to an end at a first side in a second direction, which is orthogonal to the first direction, of the pressure chamber and extending in the second direction; and a second throttle channel connected to an end at a second side in the second direction of the pressure chamber and extending in the second direction. In each of the first throttle channel and the second throttle channel, a length in a third direction orthogonal to the first direction and the second direction is longer than a length in the first direction.

18 Claims, 8 Drawing Sheets

LIQUID DISCHARGE HEAD

CROSS REFERENCE TO RELATED APPLICATION

The present application claims priority from Japanese Patent Application No. 2018-223994 filed on Nov. 29, 2018, the disclosure of which is incorporated herein by reference in its entirety.

BACKGROUND

Field of the Invention

The present invention relates to a liquid discharge head configured to discharge liquid from nozzles.

Description of the Related Art

An ink-jet print head configured to discharge ink from nozzles is known as an example of a liquid discharge head configured to discharge liquid from nozzles. In the above ink-jet print head, pressure chambers (fluidic chambers) connecting to the respective nozzles are arranged in an L direction, and throttle channels (fluidic channels) extending in a W direction orthogonal to the L direction are connected to ends in the W direction of the respective pressure chambers.

SUMMARY

In the above ink-jet print head, the throttle channels are required to have relatively high channel resistance. However, if the length in the W direction of the throttle channels is long to make the channel resistance of the throttle channels high, the size in the W direction of the ink-jet print head would be large. In the above ink-jet print head, the throttle channels extending in the W direction are connected to the ends in the W direction of the pressure chambers. In that configuration, if the length in the W direction of the throttle channels is long, the size in the W direction of the ink-jet print head would be remarkably large.

An object of the present disclosure is to provide a liquid discharge head in which throttle channels extending in one direction are connected to ends in the one direction of pressure chambers and in which the size of the liquid discharge head in the one direction is made as small as possible while making the channel resistance of the throttle channels high.

According to an aspect of the present disclosure, there is provided a liquid discharge head, including: a pressure chamber; a nozzle connected to the pressure chamber and overlapping in a first direction with the pressure chamber; a first throttle channel connected to an end at a first side in a second direction, which is orthogonal to the first direction, of the pressure chamber and extending in the second direction; and a second throttle channel connected to an end at a second side in the second direction of the pressure chamber and extending in the second direction, wherein in each of the first throttle channel and the second throttle channel, a length in a third direction orthogonal to the first direction and the second direction is longer than a length in the first direction.

DESCRIPTION OF THE EMBODIMENTS

An embodiment of the present disclosure is explained below.

<Schematic Configuration of Printer 1>

Figure 1:
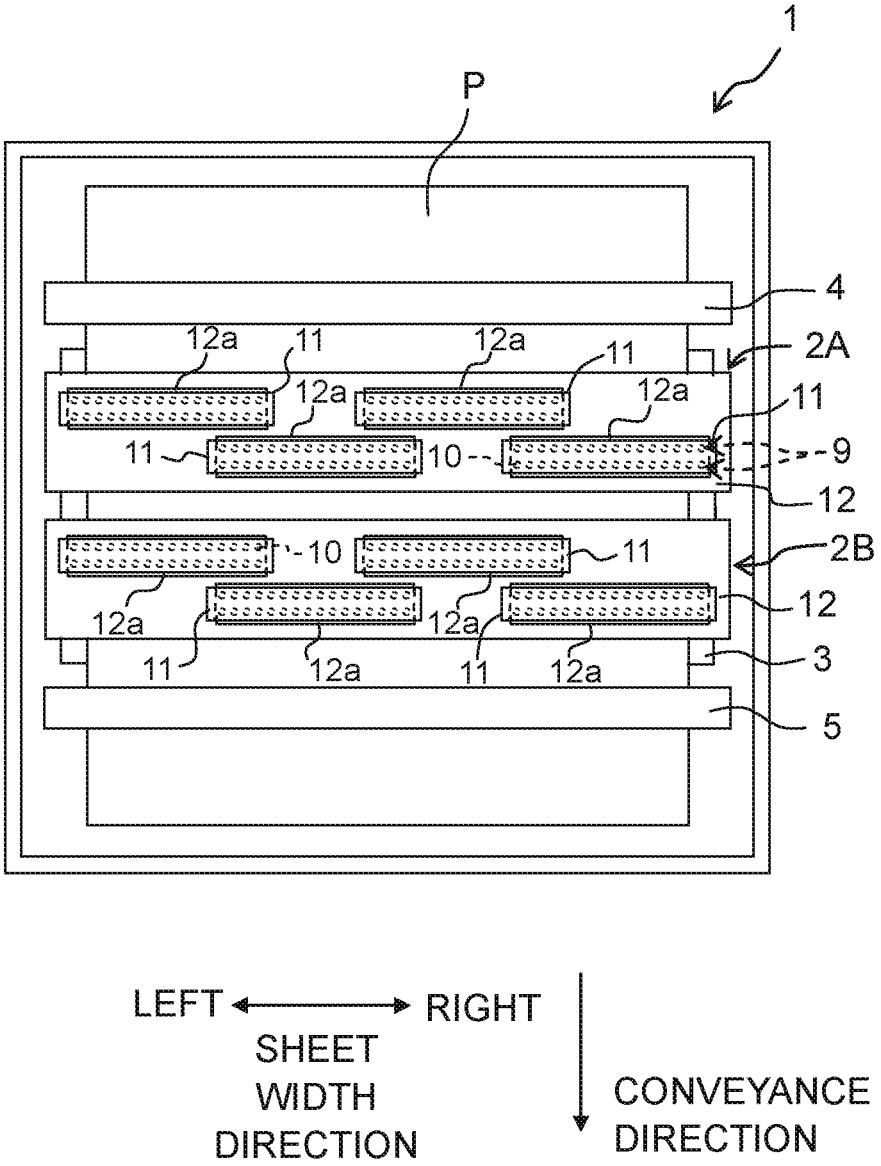
FIG. 1 schematically depicts a configuration of a printer according to an embodiment of the present disclosure.

As depicted in FIG. 1, a printer 1 according to this embodiment includes two ink-jet heads 2A, 2B, a platen 3, and conveyance rollers 4, 5. The ink-jet head 2A and the ink-jet head 2B are arranged in a conveyance direction in which a recording sheet P is conveyed. The ink-jet head 2B is positioned downstream of the ink-jet head 2A in the conveyance direction. Each of the ink-jet heads 2A and 2B includes four head units 11 and a holding member 12.

Figure 3:
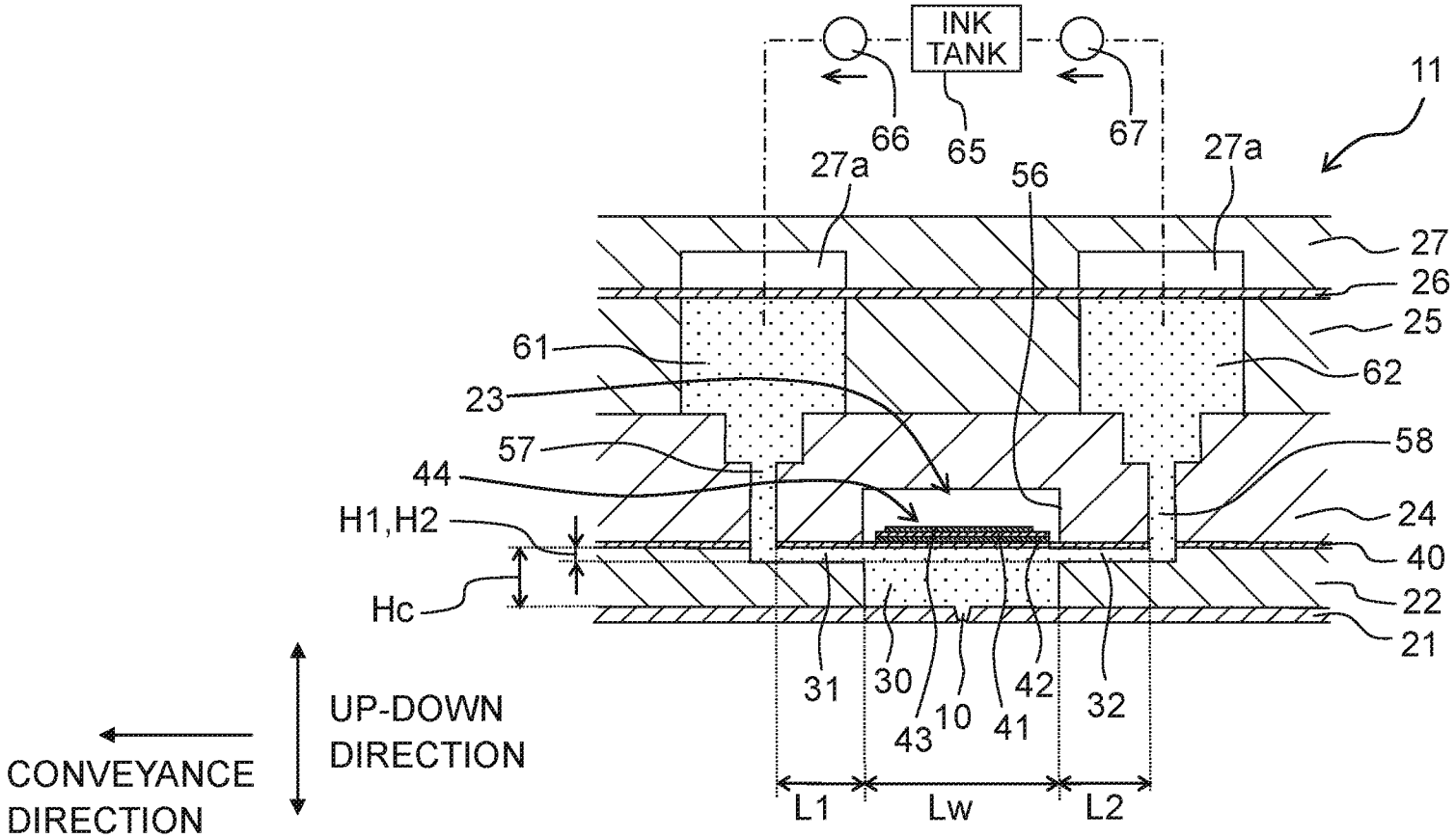
FIG. 3 is a cross-sectional view taken along a line in FIG. 2.

A lower surface of each head unit 11 is provided with nozzles 10. The nozzles 10 are aligned in a sheet width direction orthogonal to the conveyance direction to form a nozzle row 9. The head unit 11 includes two nozzle rows 9 arranged in the conveyance direction. The positions in the sheet width direction of the nozzles 10 belonging to one of the two nozzle rows 9 are the same as those belonging to the other. In the following, the right and the left in the sheet width direction are defined as indicated in FIG. 1, and an up-down direction is defined as indicated in FIG. 3.

In each head unit 11 included in the ink-jet head 2A, a black ink is discharged from nozzles 10 forming the nozzle row 9 included in the two nozzle rows 9 and positioned at an upstream side in the conveyance direction, and a yellow ink is discharged from nozzles 10 forming the nozzle row 9 included in the two nozzle rows 9 and positioned at a downstream side in the conveyance direction. In each head unit 11 included in the ink-jet head 2B, a cyan ink is discharged from nozzles 10 forming the nozzle row 9 included in the two nozzle rows 9 and positioned at the upstream side in the conveyance direction, and a magenta ink is discharged from nozzles 10 forming the nozzle row 9 included in the two nozzle rows 9 and positioned at the downstream side in the conveyance direction.

In each of the ink-jet heads 2A and 2B, two of the four head units 11 are positioned at the upstream side in the conveyance direction and the remaining two head units 11 are positioned at the downstream side in the conveyance direction. The two head units 11 arranged at the upstream side in the conveyance direction are arranged in the sheet width direction at an interval. The two head units 11 arranged at the downstream side in the conveyance direction are arranged in the sheet width direction at an interval. The two head units 11 positioned at the upstream side in the conveyance direction and the two head units 11 positioned at the downstream side in the conveyance direction are arranged in the conveyance direction at an interval. The positions in the sheet width direction of the two head units 11 at the upstream side in the conveyance direction are different from those of the two head units 11 at the downstream side in the conveyance direction. The nozzles 10 of the two head units 11 at the upstream side in the conveyance direction partially overlap in the conveyance direction with the nozzles 10 of the two head units 11 at the downstream side in the conveyance direction. In that configuration, the nozzles 10 of the four head units 11 are arranged to extend over an entire length of the recording sheet P in the sheet width direction. Namely, each of the ink-jet heads 2A and 2B is a line head extending over the entire length in the sheet width direction of the recording sheet P.

The holding member 12 is a rectangular plate member extending over the entire length in the sheet width direction of the recording sheet P. The holding member 12 is formed having four through holes 12*a* that correspond to the four head units 11. The nozzles 10 of the respective head units 11 are exposed to a lower side (recording sheet P side) via the respective through holes 12*a*.

The platen 3 is disposed below the ink-jet heads 2A and 2B to face the nozzles 10 of the ink-jet heads 2A and 2B. The platen 3 supports the recording sheet P from below.

The conveyance roller 4 is disposed upstream of the ink-jet heads 2A, 2B and the platen 3 in the conveyance direction. The conveyance roller 5 is disposed downstream of the ink-jet heads 2A, 2B and the platen 3 in the conveyance direction. The conveyance rollers 4 and 5 convey the recording sheet P in the conveyance direction.

The printer 1 performs recording on the recording sheet P by discharging ink(s) from the nozzles 10 of the ink-jet heads 2A and 2B to the recording sheet P while conveying the recording sheet P in the conveyance direction by use of the conveyance rollers 4 and 5.

<Head Unit 11>

Figure 2:
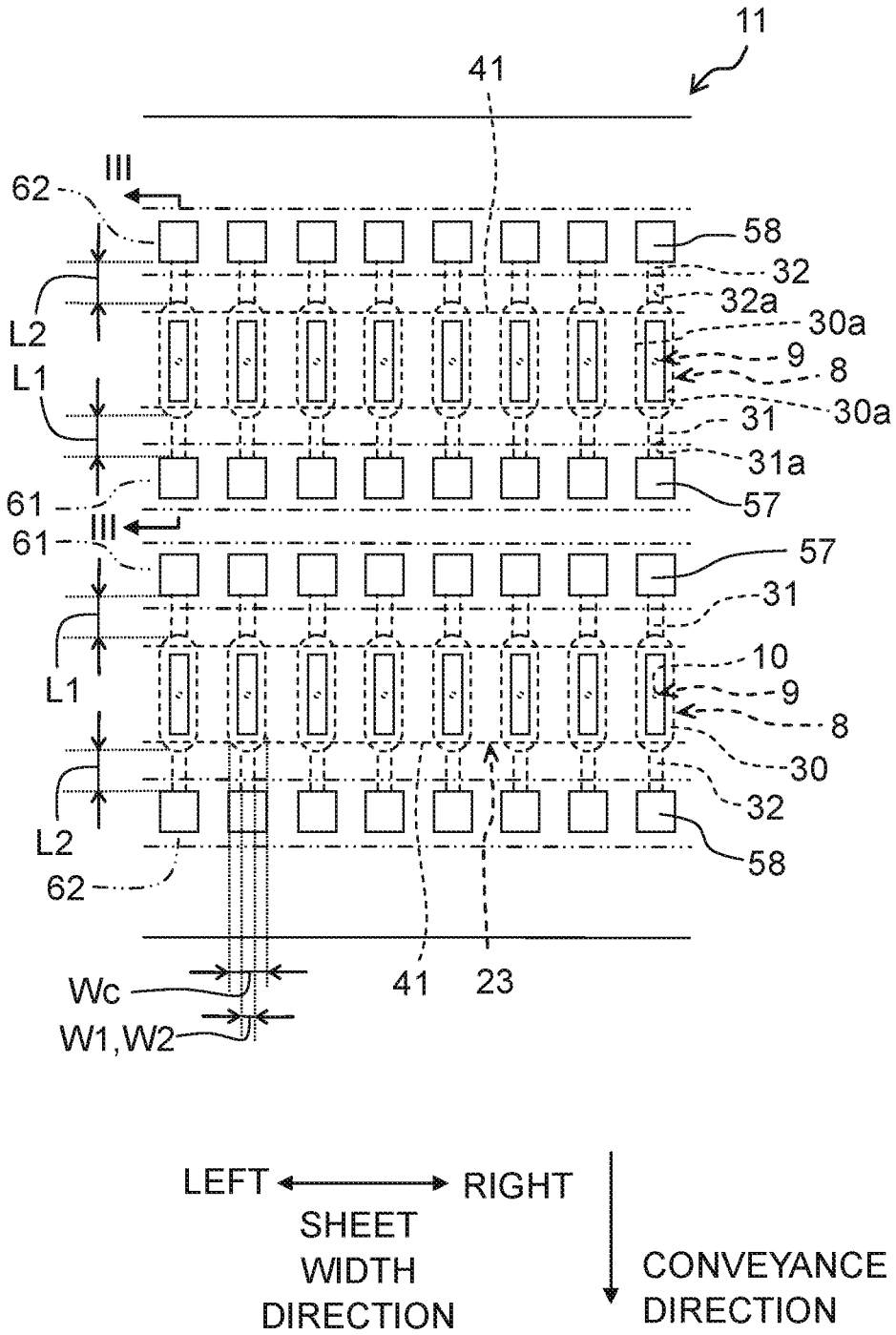
FIG. 2 is a plan view of part of a head unit depicted in FIG. 1.

Subsequently, each head unit 11 is explained. As depicted in FIGS. 2 and 3, the head unit 11 includes a nozzle plate 21, a channel substrate 22 (an exemplary channel plate of the present disclosure), a piezoelectric actuator 23, a protection substrate 24, and a manifold member 25.

The nozzle plate 21 is made using a synthetic resin material, such as polyimide. The nozzle plate 21 includes nozzles 10 forming the two nozzle rows 9, as described above.

The channel substrate 22, which is made using silicon (Si), is disposed on an upper surface of the nozzle plate 21. The channel substrate 22 includes pressure chambers 30, first throttle channels 31, and second throttle channels 32.

The pressure chambers 30 are provided corresponding to the respective nozzles 10. Each pressure chamber 30 has two inner wall surfaces 30*a* arranged in the sheet width direction. The inner wall surfaces 30*a* extend in the conveyance direction except for ends in the conveyance direction. The ends in the conveyance direction of the inner wall surfaces 30*a* of the pressure chamber 30 curve toward a center portion in the sheet width direction of the pressure chamber 30 (are inclined to the conveyance direction) as the ends in the conveyance direction of the inner wall surfaces 30*a* are farther away from the center portion in the conveyance direction of the pressure chamber 30.

A center portion of each of the pressure chambers 30 overlaps in the up-down direction with the corresponding one of the nozzles 10. In the channel substrate 22, two pressure chamber rows 8 are arranged in the conveyance direction while corresponding to the two respective nozzle rows 9. Each of the pressure chamber rows 8 is formed by arranging the pressure chambers 30 in the sheet width direction.

The first throttle channels 31 are provided corresponding to the respective pressure chambers 30. The shape of each first throttle channel 31 as viewed in the conveyance direction is a rectangle in which a length W1 in the sheet width direction is longer than a length H1 in the up-down direction. Specifically, the length W1 in the sheet width direction of the first throttle channel 31 is 2.6 times or more and 4.3 times or less of the length H1 in the up-down direction. The length W1 in the sheet width direction and the length H1 in the up-down direction of the first throttle channel 31 are constant independently of the position in the conveyance direction.

The respective first throttle channels 31 corresponding to the respective pressure chambers 30 that form the pressure chamber row 8 at the upstream side in the conveyance direction are connected to ends of the respective pressure chambers 30 at the downstream side in the conveyance direction (an example of a first side in a second direction of the present disclosure). The first throttle channels 31 extend downstream in the conveyance direction from connection portions with the pressure chambers 30. The respective first throttle channels 31 corresponding to the respective pressure chambers 30 that form the pressure chamber row 8 at the downstream side in the conveyance direction are connected to ends of the respective pressure chambers 30 at the upstream side in the conveyance direction (an example of the first side in the second direction of the present disclosure). The respective first throttle channels 31 extend upstream in the conveyance direction from connections portion with the pressure chambers 30.

The length W1 in the sheet width direction of the first throttle channel 31 is shorter than a length We in the sheet width direction of the pressure chamber 30. The first throttle channel 31 is connected to a center portion in the sheet width direction of the end at the first side in the conveyance direction of the pressure chamber 30. Ends at the first side in the conveyance direction of the two inner wall surfaces 30*a* of the pressure chamber 30 are connected to two inner wall surfaces 31*a* of the first throttle channel 31.

The length H1 in the up-down direction of the first throttle channel 31 is shorter than a length Hc in the up-down direction of the pressure chamber 30. The first throttle channel 31 is connected to an upper end portion of the end at the first side in the conveyance direction of the pressure chamber 30. The length H1 is preferably shorter than half of the length Hc.

Figure 4:
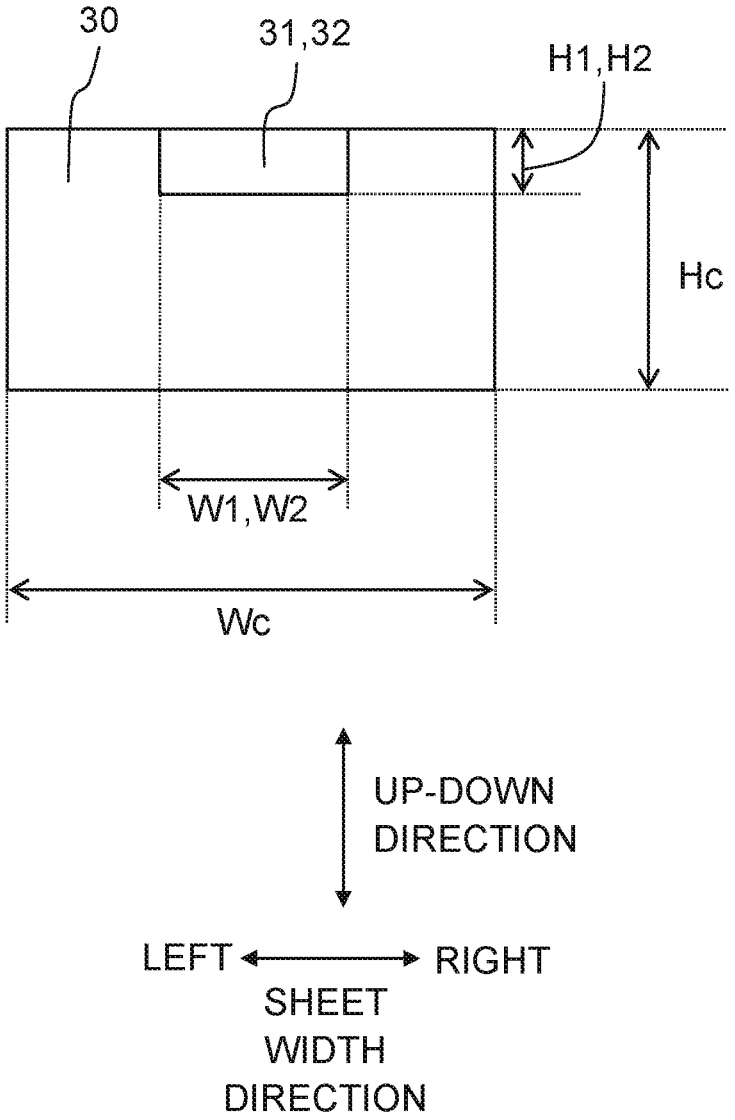
FIG. 4 depicts a positional relationship between a pressure chamber and an inflow throttle channel and an outflow throttle channel as viewed in a conveyance direction.

The second throttle channels 32 are provided corresponding to the respective pressure chambers 30. As depicted in FIG. 4, the shape of the second throttle channel 32 as viewed in the conveyance direction is a rectangle in which a length W2 in the sheet width direction is longer than a length H2 in the up-down direction. Specifically, the length W2 in the sheet width direction of the second throttle channel 32 is 2.6 times or more and 4.3 times or less of the length H2 in the up-down direction. The length W2 in the sheet width direction and the length H2 in the up-down direction of the second throttle channel 32 are constant independently of the position in the conveyance direction.

The respective second throttle channels 32 corresponding to the respective pressure chambers 30 that form the pressure chamber row 8 at the upstream side in the conveyance direction are connected to ends of the respective pressure chambers 30 at the upstream side in the conveyance direction (an example of a second side in the second direction of the present disclosure). The second throttle channels 32 extend upstream in the conveyance direction from connection portions with the pressure chambers 30. The respective second throttle channels 32 corresponding to the respective pressure chambers 30 that form the pressure chamber row 8 at the downstream side in the conveyance direction are connected to ends of the respective pressure chambers 30 at the downstream side in the conveyance direction (an example of the second side in the second direction of the present disclosure). The second throttle channels 32 extend downstream in the conveyance direction from connection portions with the pressure chambers 30.

As depicted in FIG. 4, the length W2 in the sheet width direction of the second throttle channel 32 is shorter than the length Wc in the sheet width direction of the pressure chamber 30. The second throttle channel 32 is connected to a center portion in the sheet width direction of the end at the second side in the conveyance direction of the pressure chamber 30. Ends at the second side in the conveyance direction of the two inner wall surfaces 30*a* of the pressure chamber 30 are connected to two inner wall surfaces 32*a* of the second throttle channel 32.

As depicted in FIGS. 3 and 4, the length H2 in the up-down direction of the second throttle channel 32 is shorter than the length Hc in the up-down direction of the pressure chamber 30. The second throttle channel 32 is connected to an upper end portion of the end at the second side in the conveyance direction of the pressure chamber 30.

The length W1 in the sheet width direction of the first throttle channel 31 is the same as the length W2 in the sheet width direction of the second throttle channel 32. The length H1 in the up-down direction of the first throttle channel 31 is the same as the length H2 in the up-down direction of the second throttle channel 32. A length L1 in the conveyance direction of the first throttle channel 31 is the same as a length L2 in the conveyance direction of the second throttle channel 32. This makes the channel resistance of the first throttle channel 31 equal to the channel resistance of the second throttle channel 32. In this embodiment, the fact that the channel resistance of the first throttle channel 31 is equal to the channel resistance of the second throttle channel 32 means that the channel resistance of the first throttle channel 31 is exactly the same as the channel resistance of the second throttle channel 32 and that the channel resistance of the first throttle channel 31 differs from the channel resistance of the second throttle channel 32 by not more than 5% due to a manufacturing error and the like.

The length Wc is, for example, not less than 60 μm and not more than 65 μm. Each of the lengths W1 and W2 is, for example, not less than 40 μm and not more than 55 μm. The length Hc is, for example, not less than 100 μm and not more than 140 μm. Each of the lengths H1 and H2 is, for example, not less than 20 μm and not more than 30 μm. Each of the lengths L1 and L2 is, for example, not less than 20 μm and not more than 200 μm. A length Lw in the conveyance direction of the pressure chamber 30 is not less than 550 μm and not more than 650 μm.

<Piezoelectric Actuator 23>

The piezoelectric actuator 23 includes a vibration film 40, two piezoelectric films 41, lower electrodes 42, and upper electrodes 43.

The vibration film 40 is made using silicon dioxide ($SiO_2$), silicon nitride (SiN), or the like. The vibration film 40 is formed by oxygenating or nitriding an upper end of the channel substrate 22. The vibration film 40 covers the pressure chambers 30.

The piezoelectric films 41 are made using a piezoelectric material that includes lead zirconate titanate as a main component. The lead zirconate titanate is a mixed crystal of lead titanate and lead zirconate. The piezoelectric films 41 are disposed on an upper surface of the vibration film 40. The two piezoelectric films 41 correspond to the two pressure chamber rows 8. The piezoelectric films 41 extend in the sheet width direction to cover the pressure chambers 30 forming the respective pressure chamber rows 8.

The lower electrodes 42 are made, for example, using platinum (Pt). Each of the lower electrodes 42 is formed corresponding to one of the pressure chambers 30. The shape of the lower electrode 42 as viewed in the up-down direction is a rectangle of which longitudinal direction is the conveyance direction. The lower electrode 42 is disposed between the vibration film 40 and the piezoelectric film 41 to overlap in the up-down direction with the center portion of the pressure chamber 30. The lower electrodes 42 are kept at the ground potential.

The upper electrodes 43 are made, for example, using platinum (Pt) or iridium (Ir). Each of the upper electrodes 43 is formed corresponding to one of the pressure chambers 30. The shape of the upper electrode 43 as viewed in the up-down direction is a rectangle that is long in the conveyance direction. The upper electrode 43 is disposed on an upper surface of the piezoelectric film 41 to overlap in the up-down direction with the center portion of the pressure chamber 30. A driver IC (not depicted) selectively applies any of the ground potential and a predefined driving potential to the upper electrodes 43.

Portions included in the piezoelectric actuator 23 and overlapping in the up-down direction with the pressure chambers 30 are driving elements 44. Each of the driving elements 44 applies pressure to ink in the corresponding one of the pressure chambers 30.

Here, explanation is made about a method of driving each of the driving elements 44 to apply pressure to ink in the corresponding one of the pressure chambers 30 and discharging ink from the corresponding one of the nozzles 10. In the piezoelectric actuator 23, the upper electrodes 43 of all the driving elements 44 are kept at the ground potential. In order to discharge ink from a certain nozzle 10, the electric potential of the upper electrode 43 of the driving element 44 corresponding to the certain nozzle 10 is switched to the driving potential. This causes the difference in potential between the lower electrode 42 and the upper electrode 43, generating an electric field in a thickness direction at part of the piezoelectric film 41 interposed between the lower electrode 42 and the upper electrode 43. The part of the piezoelectric film 41 contracts in a horizontal direction orthogonal to the direction of the electric field. In that situation, the piezoelectric film 41 and the vibration film 40 are deformed to be convex toward the pressure chamber 30 side, thus making the volume of the pressure chamber 30 small. The pressure of ink in the pressure chamber 30 is thus increased, which discharges ink from the nozzle 10 communicating with the pressure chamber 30. After discharge of ink, the electric potential of the upper electrode 43 returns to the ground potential.

<Protection Substrate 24>

As depicted in FIGS. 2 and 3, the protection substrate 24 is placed on the upper surface of the channel substrate 22 provided with the piezoelectric actuator 23. A lower surface of the protection substrate 24 includes two recesses 56. The two recesses 56 correspond to the two pressure chamber rows 8 and extend in the sheet width direction over the pressure chambers 30 forming the respective pressure chamber rows 8. A space between the recess 56 and the channel substrate 22 accommodates the driving elements 44 corresponding to the pressure chambers 30.

The protection substrate 24, the vibration film 40, and the channel substrate 22 are formed having first connection channels 57 and second connection channels 58.

The first connection channels 57 are provided corresponding to the respective first throttle channels 31. Each of the first connection channels 57 extends in the up-down direction over the entirety of the protection substrate 24, the entirety of the vibration film 40, and the upper end of the channel substrate 22. A lower end of the first connection channel 57 has the same height as the first throttle channel 31. The lower end of the first connection channel 57 is connected to an end of the first throttle channel 31 on the side opposite to the pressure chamber 30 in the conveyance direction.

The second connection channels 58 are provided corresponding to the respective second throttle channels 32. The second connection channel 58 extends in the up-down direction over the entirety of the protection substrate 24, the entirety of the vibration film 40, and the upper end of the channel substrate 22. A lower end of the second connection channel 58 has the same height as the second throttle channel 32. The lower end of the second connection channel 58 is connected to an end of the second throttle channel 32 on the side opposite to the pressure chamber 30 in the conveyance direction.

<Manifold Member 25>

The manifold member 25 is disposed on an upper surface of the protection substrate 24. The manifold member 25 includes two first manifolds 61 and two second manifolds 62.

The two first manifolds 61 correspond to the two pressure chamber rows 8. Each of the first manifolds 61 extends in the sheet width direction over the first connection channels 57 that communicate with the pressure chambers 30 forming the corresponding one of the pressure chamber rows 8. The first manifold 61 is connected to an upper end of the first connection channel 57. The two second manifolds 62 correspond to the two pressure chamber rows 8. Each of the second manifolds 62 extends in the sheet width direction over the second connection channels 58 that communicate with the pressure chambers 30 forming the corresponding one of the pressure chamber rows 8. The second manifold 62 is connected to an upper end of the second connection channel 58.

The first manifold 61 and the second manifold 62 corresponding to each pressure chamber row 8 are connected to the same ink tank 65 via respective channels (not depicted). A first pump 66 is provided in a channel between the first manifold 61 and the ink tank 65 to feed ink from the ink tank 65 to the first manifold 61. A second pump 67 is provided in a channel between the second manifold 62 and the ink tank 65 to feed ink from the second manifold 62 to the ink tank 65.

Driving the first pump 66 and the second pump 67 allows ink in the ink tank 65 to flow into the first manifold 61 via the channel (not depicted), and then ink flows from the first manifold 61 to the pressure chambers 30 via the first connection channels 57 and the first throttle channels 31. Further, ink in the pressure chambers 30 flows out to the second manifold 62 via the second throttle channels 32 and the second connection channels 58, and then ink returns to the ink tank 65 from the second manifold 62 via the channel (not depicted). This causes ink to circulate between the ink tank 65 and the head unit 11. Although both the first pump 66 and the second pump 67 are provided in this embodiment, only one of them may be provided. In that case, driving the pump allows ink to circulate similarly to the above.

A damper film 26 is disposed on an upper surface of the manifold member 25. The first manifolds 61 and the second manifolds 62 are covered with the damper film 26. Deformation of portions included in the damper film 26 and overlapping in the up-down direction with the first manifolds 61 and the second manifolds 62 inhibits the pressure change in ink in the first manifolds 61 and the second manifolds 62. A damper chamber member 27 is disposed on an upper surface of the damper film 26. Damper chambers 27*a* are formed at portions included in a lower surface of the damper chamber member 27 and overlapping in the up-down direction with the first manifolds 61 and the second manifolds 62. The damper chambers 27*a* are spaces for receiving upward deformation of the damper film 26.

<Effect>

Figure 5:
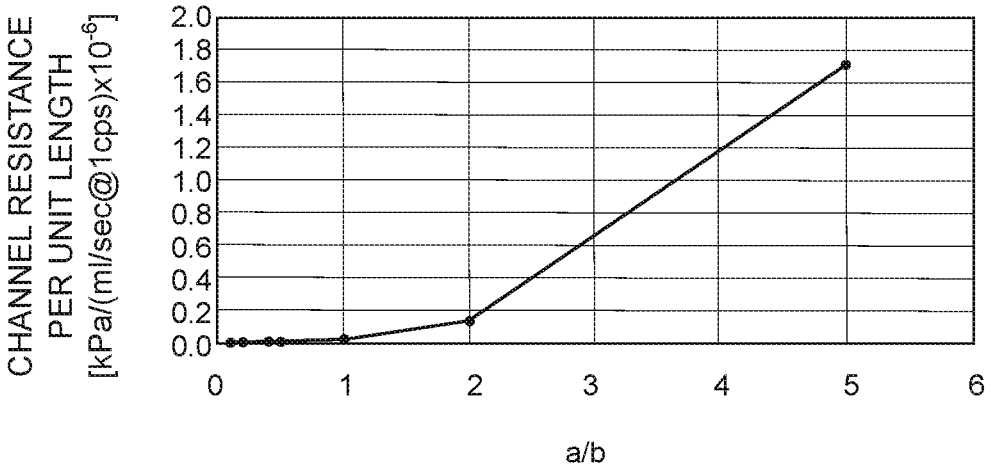
FIG. 5 depicts a relationship between a ratio of a length in a sheet width direction to a length in an up-down direction and a channel resistance per unit length, in a channel extending in the conveyance direction and having a rectangular cross-section.

If the channels extending in the conveyance direction, such as the first throttle channel 31 and the second throttle channel 32 in this embodiment, have the same cross-sectional area orthogonal to the conveyance direction, the channel resistance per unit length is higher as the length in the sheet width direction is longer. For example, a channel in which the cross-section orthogonal to the conveyance direction is a rectangle has a relationship between a ratio (a/b) of a length a in the sheet width direction of a length b in the up-down direction and a channel resistance R per unit length, as depicted in FIG. 5. The relationship depicted in FIG. 5 is obtained based on the following equation. In the following equation, μ represents ink viscosity (cps). Further, n represents a natural number. The accuracy of the channel resistance calculated is higher as n is greater. Furthermore, tanh represents a hyperbolic tangent.

$$R = \frac{1}{ab} \cdot \frac{1}{\frac{b^2}{64\mu}\left(\frac{16}{3} - \frac{1024}{\pi}\frac{b}{a}\sum_{n}\frac{1}{n^5}\tanh\left(\frac{n\pi a}{2b}\right)\right)}$$

In this embodiment, the length in the sheet width direction of each of the first throttle channel 31 and the second throttle channel 32 is longer than the length in the up-down direction thereof. The channel resistance per unit length of each of the first throttle channel 31 and the second throttle channel 32 is higher than a case in which the length in the sheet width direction of each of the first throttle channel 31 and the second throttle channel 32 is equal to the length in the up-down direction thereof. In that configuration, the length in the conveyance direction of each of the first throttle channel 31 and the second throttle channel 32 is shortened to achieve a desired channel resistance, thus downsizing the head unit 11 in the conveyance direction.

Especially, in this embodiment, the first throttle channel 31 extending in the conveyance direction and the second throttle channel 32 extending in the conveyance direction are connected to the ends in the conveyance direction of the pressure chamber 30. In that configuration, the effect of downsizing the head unit 11 in the conveyance direction is especially enhanced by shortening the length in the conveyance direction of each of the first throttle channel 31 and the second throttle channel 32.

It is understood from FIG. 5 that the change in the channel resistance R per unit length with respect to the change in the ratio (a/b) is greater in a range where the ratio (a/b) is equal to or more than two than in a range where the ratio (a/b) is less than two. In this embodiment, the length W1 in the sheet width direction of the first throttle channel 31 is two times or more (2.6 times or more and 4.3 times or less) of the length H1 in the up-down direction. The length W2 in the sheet width direction of the second throttle channel 32 is two times or more (2.6 times or more and 4.3 times or less) of the length H2 in the up-down direction. It is thus possible to make the channel resistance per unit length of each of the first throttle channel 31 and the second throttle channel 32 sufficiently high, and it is possible to make the length in the conveyance direction of each of the first throttle channel 31 and the second throttle channel 32 sufficiently short.

It is understood from FIG. 5 that the channel resistance R per unit length when the ratio (a/b) is equal to or more than 2.6 is 10 times or more of the channel resistance R per unit length when the ratio (a/b) is 1. In this embodiment, the length W1 in the sheet width direction of the first throttle channel 31 is 2.6 times or more of the length H1 in the up-down direction. The length W2 in the sheet width direction of the second throttle channel 32 is 2.6 times or more of the length H2 in the up-down direction. It is thus possible to make the channel resistance per unit length of each of the first throttle channel 31 and the second throttle channel 32 sufficiently high (10 times or more of the case where the ratio (a/b) is 1), and it is possible to make the length in the conveyance direction of each of the first throttle channel 31 and the second throttle channel 32 sufficiently short (one-tenth or less of the case where the ratio (a/b) is 1).

When the length L1 in the conveyance direction of the first throttle channel 31 and the length L2 in the conveyance direction of the second throttle channel 32 are too short (e.g., less than 10 μm), it may be difficult to form the first throttle channel 31 and the second throttle channel 32. Specifically, the first throttle channel 31 and the second throttle channel 32 are formed, for example, by performing etching on the channel substrate 22. In that case, if the length L1 in the conveyance direction of the first throttle channel 31 and the length L2 in the conveyance direction of the second throttle channel 32 are too short, etching processing may not be performed uniformly. This may result in unevenness in the lengths L1 and L2 and may fail to obtain the desired channel resistance of the first throttle channel 31 and the second throttle channel 32.

When the ratio (a/b) is 1, the length in the conveyance direction of each of the first throttle channel 31 and the second throttle channel 32 that is required to obtain the desired channel resistance depends on a volume of ink discharged from the nozzle 10, a drive frequency of the driving element 44, the size of the pressure chamber 30, and the like. For example, when the ratio (a/b) is 1 in a head unit in which the lengths Wc, Hc, and Lc in the respective directions of the pressure chamber 30 are those described above, the volume of ink discharged from the nozzle 10 is approximately 4 pl, and the drive frequency of the driving element 44 is approximately 100 kHz, the length in the conveyance direction of each of the first throttle channel 31 and the second throttle channel 32 that is required to obtain the desired channel resistance may be approximately 400 μm. Thus, in this embodiment, the length W1 in the sheet width direction of the first throttle channel 31 is 4.3 times or less of the length H1 in the up-down direction, and the length W2 in the sheet width direction of the second throttle channel 32 is 4.3 times or less of the length H2 in the up-down direction. This inhibits the length L1 in the conveyance direction of the first throttle channel 31 and the length L2 in the conveyance direction of the second throttle channel 32 from being too short (e.g., the lengths L1 and L2 are inhibited from being less than 10 μm).

In this embodiment, bubbles are accumulated in an upper end of the pressure chamber 30. In order to solve this problem, the upper end of the pressure chamber 30 is connected to the second throttle channel 32 through which ink flows out of the pressure chamber 30. This efficiently discharges bubbles in the pressure chamber 30 to the second throttle channel 32.

There may be a configuration in which the second throttle channel 32 is connected to the upper end of the pressure chamber 30 like this embodiment and the first throttle channel 31 is connected, for example, to a lower end of the pressure chamber 30 unlike this embodiment. In that configuration, when ink circulates as described above, flow of ink in the pressure chamber 30 from a connection portion with the first throttle channel 31 toward a connection portion with the second throttle channel 32 has a relatively large component in the up-down direction. The flow of ink having the large component in the up-down direction may interfere with deformation of the vibration film 40 and the piezoelectric film 41 when the driving element 44 is driven as described above.

In this embodiment, the first throttle channel 31 and the second throttle channel 32 are connected to the upper end of the pressure chamber 30. In that configuration, when the ink circulates as described above, flow of ink in the pressure chamber 30 from the connection portion with the first throttle channel 31 to the connection portion with the second throttle channel 32 mainly has a large component in the conveyance direction and a small component in the up-down direction. The flow of ink is thus not likely to interfere with the deformation of the vibration film 40 and the piezoelectric film 41 when the driving element 44 is driven.

In this embodiment, the first throttle channel 31 is connected to the lower end of the first connection channel 57, and thus the first connection channel 57 is not positioned on the lower side of the first throttle channel 31. The second throttle channel 32 is connected to the lower end of the second connection channel 58, and thus the second connection channel 58 is not positioned on the lower side of the second throttle channel 32. Ink is thus not likely to stagnate in the first connection channel 57 and the second connection channel 58.

In this embodiment, the length W2 in the sheet width direction and the length H2 in the up-down direction of each second throttle channel 32 are constant independently of the position in the conveyance direction. The channel resistance per unit length of each second throttle channel 32 is thus constant independently of the position in the conveyance direction, and a portion where the flow rate of ink is slow is hard to be generated. This reliably discharges bubbles in the pressure chamber 30 to the second throttle channel 32. Ink is thus not likely to stagnate in the second throttle channel 32.

In this embodiment, the length W1 in the sheet width direction and the length H1 in the up-down direction of each first throttle channel 31 are constant independently of the position in the conveyance direction. The channel resistance per unit length of each first throttle channel 31 is thus constant independently of the position in the conveyance direction, and a portion where the flow rate of ink is slow is hard to be generated. Ink is thus not likely to stagnate in the first throttle channel 31.

In this embodiment, the length W1 in the sheet width direction of the first throttle channel 31 and the length W2 in the sheet width direction of the second throttle channel 32 are shorter than the length We in the sheet width direction of the pressure chamber 30. Neither the first throttle channel 31 nor the second throttle channel 32 extend outward beyond the pressure chamber 30 in the sheet width direction. This makes the length in the sheet width direction of the space required for arranging the pressure chambers 30, the first throttle channels 31, and the second throttle channels 32 short. Further, it is possible to reduce a spaced interval in the sheet width direction between the pressure chambers 30 aligned in the sheet width direction.

During the ink circulation, the flow rate of ink in the pressure chamber 30 from the first throttle channel 31 to the second throttle channel 32 is fastest at the center portion in the sheet width direction in the pressure chamber 30. In this embodiment, the first throttle channel 31 and the second throttle channel 32 are connected to the center portion in the sheet width direction of the pressure chamber 30. This allows ink in the pressure chamber 30 to smoothly flow from the first throttle channel 31 to the second throttle channel 32.

In this embodiment, the ends in the conveyance direction of the two inner wall surfaces 30*a* of the pressure chamber 30 facing in the sheet width direction curve toward the center portion in the sheet width direction of the pressure chamber 30 as the ends in the conveyance direction of the inner wall surfaces 30*a* are farther away from the center portion in the conveyance direction of the pressure chamber 30. The ends in the conveyance direction of the inner wall surfaces 30*a* of the pressure chamber 30 are connected to the inner wall surfaces 31*a* of the first throttle channel 31 and the inner wall surfaces 32*a* of the second throttle channel 32. This allows bubbles in the pressure chamber 30 to easily flow along the inner wall surfaces 30*a* of the pressure chamber 30 and the inner wall surfaces 32*a* of the second throttle channel 32. The bubbles in the pressure chamber 30 are thus efficiently discharged to the second throttle channel 32.

In this embodiment, the channel substrate 22, which is one of the channel plates, includes the pressure chambers 30, the first throttle channels 31, and the second throttle channels 32. This makes the structure of the head unit 11 simple.

In this embodiment, the channel resistance of the first throttle channel 31 is the same as the channel resistance of the second throttle channel 32. Thus, the flowability of ink from the first throttle channel 31 to the pressure chambers 30 is nearly equal to the flowability of ink from the pressure chamber 30 to the second throttle channel 32. This inhibits a shortage of ink supply to the pressure chamber 30 and excessive supply of ink to the pressure chamber 30.

Modified Examples

Although the embodiment of the present disclosure is explained above, the present disclosure is not limited to the above embodiment, and a variety of modifications are possible without departing from the claims.

In the above embodiment, the ends in the conveyance direction of the two inner wall surfaces 30*a* of the pressure chamber 30 facing in the sheet width direction curve toward the center portion in the sheet width direction of the pressure chamber 30 as the ends in the conveyance direction of the inner wall surfaces 30*a* are farther away from the center portion in the conveyance direction of the pressure chamber 30. The present disclosure, however, is not limited thereto.

For example, the ends in the conveyance direction of the two inner wall surfaces of the pressure chamber 30 facing in the sheet width direction may be flat surfaces inclined to the conveyance direction so that portions of the flat surfaces farther away from the center portion in the conveyance direction of the pressure chamber 30 approach the center portion in the sheet width direction of the pressure chamber 30.

In each of the two inner wall surfaces of the pressure chamber 30, only the end at the second throttle channel 32 side in the conveyance direction may be the curved surface or the flat surface inclined to the conveyance direction.

The shape of the pressure chamber 30 as viewed in the up-down direction may be a rectangle that is long in the conveyance direction. Namely, the pressure chamber 30 may not have the curved surface and the flat surface inclined to the conveyance direction.

In the above embodiment, the length W1 in the sheet width direction of the first throttle channel 31 and the length W2 in the sheet width direction of the second throttle channel 32 are shorter than the length We in the sheet width direction of the pressure chamber 30. The first throttle channel 31 and the second throttle channel 32 are connected to the center portions in the sheet width direction of the respective ends in the conveyance direction of the pressure chamber 30. The present disclosure, however, is not limited thereto. For example, the first throttle channel 31 may be connected to any one side in the sheet width direction of the end of the pressure chamber 30 at the first side in the conveyance direction, and/or the second throttle channel 31 may be connected to any one side in the sheet width direction of the end of the pressure chamber 30 at the second side in the conveyance direction.

In the above embodiment, the pressure chambers 30 are aligned in the sheet width direction to form the pressure chamber rows 8. The first throttle channels 31 and the second throttle channels 32 are aligned in the sheet width direction while corresponding to the pressure chamber rows 8. The present disclosure, however, is not limited thereto. The positional relationship between the pressure chambers 30 may be different from that in the above embodiment. If the length W1 in the sheet width direction of the first throttle channel 31 and the length W2 in the sheet width direction of the second throttle channel 32 are shorter than the length Wc in the sheet width direction of the pressure chamber 30, it is possible to shorten the length in the sheet width direction of the space where the pressure chambers 30, the first throttle channels 31, and the second throttle channels 32 are placed.

The length W1 in the sheet width direction of the first throttle channel 31 and the length W2 in the sheet width direction of the second throttle channel 32 may be not less than the length Wc in the sheet width direction of the pressure chamber 30. Each of the first throttle channel 31 and the second throttle channel 32 may be connected to an entire portion in the sheet width direction of the corresponding one of the ends in the conveyance direction of the pressure chamber 30.

In the above embodiment, the length W1 in the sheet width direction and the length H1 in the up-down direction of the first throttle channel 31 are constant independent of the position in the conveyance direction. The present disclosure, however, is not limited thereto. At least one of the length in the sheet width direction and the length in the up-down direction of the first throttle channel 31 may vary depending on the position in the conveyance direction. In that case, the channel resistance of the first throttle channel 31 may vary depending on the position in the conveyance direction.

In the above embodiment, the length W2 in the sheet width direction and the length H2 in the up-down direction of the second throttle channel 32 are constant independent of the position in the conveyance direction. The present disclosure, however, is not limited thereto. At least one of the length in the sheet width direction and the length in the up-down direction of the second throttle channel 32 may vary depending on the position in the conveyance direction. In that case, the channel resistance of the second throttle channel 32 may vary depending on the position in the conveyance direction.

In the above embodiment, the lower end of the first connection channel 57 is connected to the end of the first throttle channel 31 on the side opposite to the pressure chamber 30 in the conveyance direction. The first connection channel 57 is not positioned on the lower side of the first throttle channel 31. The lower end of the second connection channel 58 is connected to the end of the second throttle channel 32 on the side opposite to the pressure chamber 30 in the conveyance direction. The second connection channel 58 is not positioned on the lower side of the second throttle channel 32. The present disclosure, however, is not limited thereto. For example, the first connection channel 57 may extend downward beyond the first throttle channel 31. The second connection channel 58 may extend downward beyond the second throttle channel 32.

In the above embodiment, the first throttle channel 31 and the second throttle channel 32 are connected to the upper end of the pressure chamber 30. The present disclosure, however, is not limited thereto.

Figure 6:
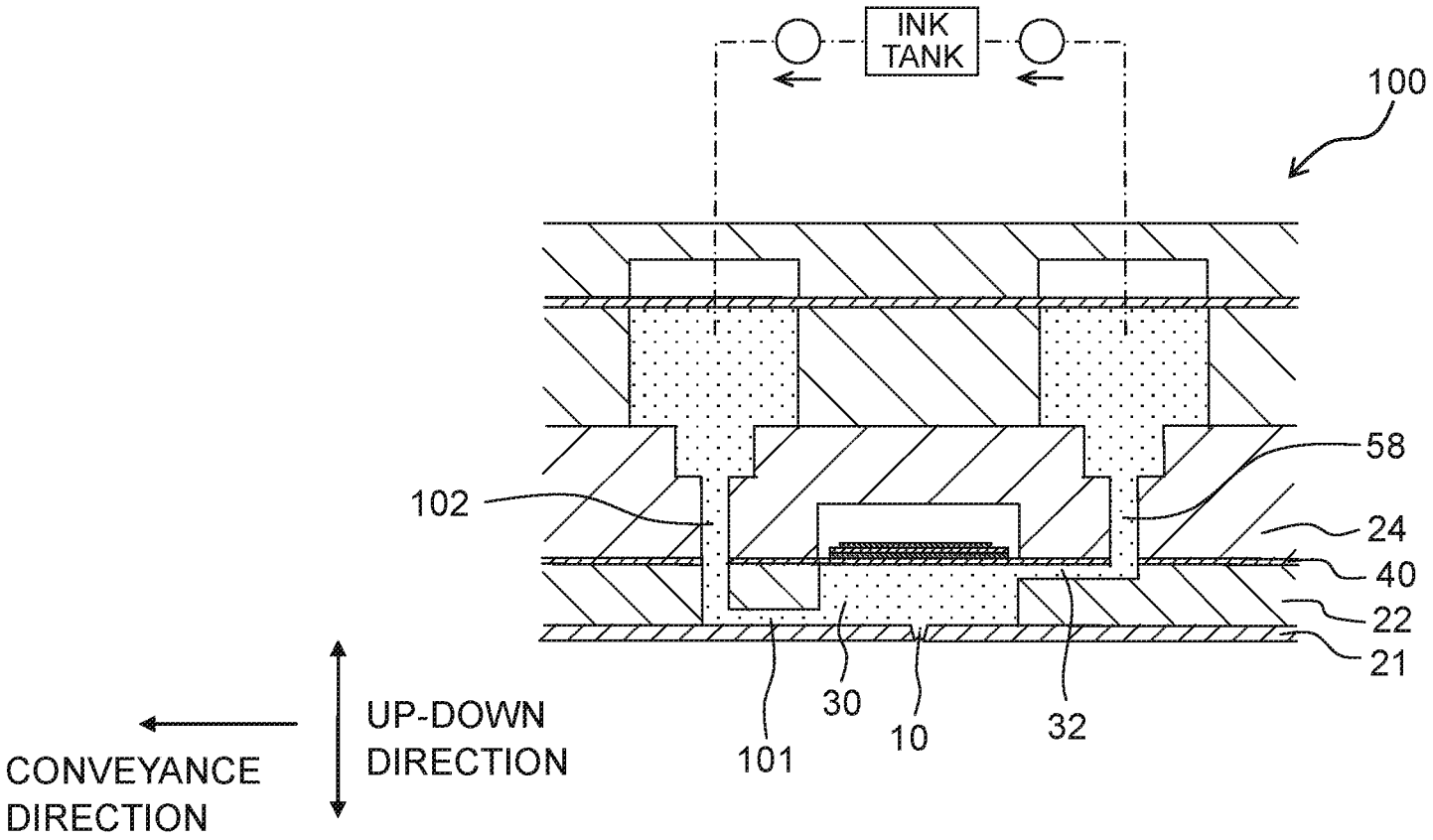
FIG. 6 is a cross-sectional view of a head unit according to a first modified example, wherein the cross-sectional view corresponds to FIG. 3.

For example, in a head unit 100 of a first modified example, the second throttle channel 32 is connected to the upper end of the pressure chamber 30 similar to the above embodiment, as depicted in FIG. 6. A first throttle channel 101 is connected to the lower end of the pressure chamber 30. A first connection channel 102 extends in the up-down direction over the entirety of the protection substrate 24, the entirety of the vibration film 40, and the entirety of the channel substrate 22. The first throttle channel 101 is connected to a lower end of the first connection channel 102.

In the first modified example, the first throttle channel 101 is connected to the lower end of the pressure chamber 30, which inhibits bubbles from flowing into the pressure chamber 30 through the first throttle channel 101.

Figure 7:
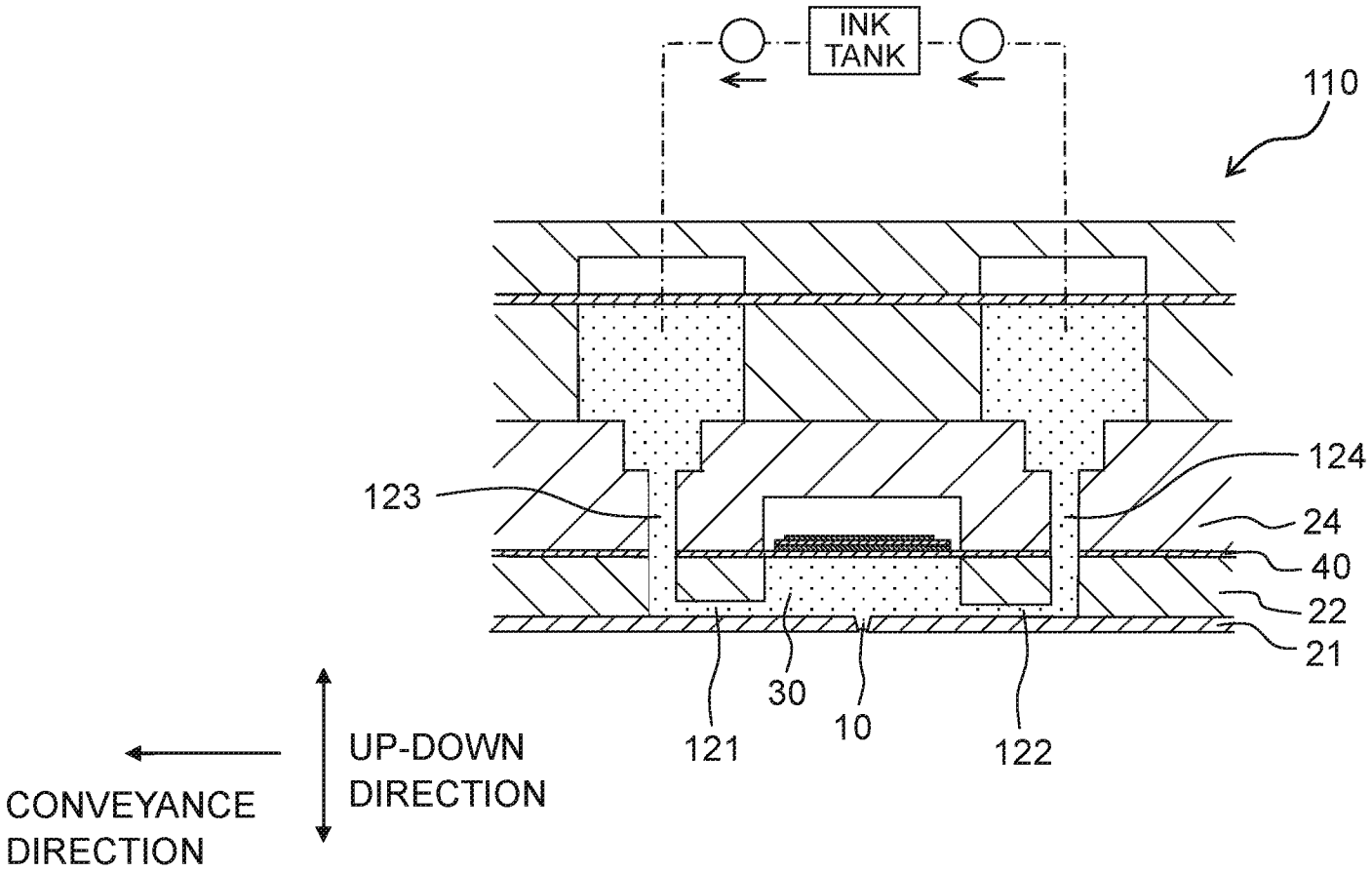
FIG. 7 is a cross-sectional view of a head unit according to a second modified example, wherein the cross-sectional view corresponds to FIG. 3.

In a head unit 110 of a second modified example, a first throttle channel 121 and a second throttle channel 122 are connected to the lower end of the pressure chamber 30, as depicted in FIG. 7. A first connection channel 123 and a second connection channel 124 extend in the up-down direction over the entirety of the protection substrate 24, the entirety of the vibration film 40, and the entirety of the channel substrate 22. The first throttle channel 121 is connected to a lower end of the first connection channel 123, and the second throttle channel 122 is connected to a lower end of the second connection channel 124.

In the above configuration, the flow of ink through the pressure chamber 30 from the first throttle channel 121 to the second throttle channel 122 is mainly generated at a lower end of the pressure chamber 30 close to the nozzle 10. The flow of ink inhibits drying of ink in the nozzle 10.

In the above embodiment, the channel substrate 22, which is one of the channel plates, includes the pressure chambers 30, the first throttle channels 31, and the second throttle channels 32. The present disclosure, however, is not limited thereto. For example, instead of the channel substrate 22, the head unit may include multiple channel plates stacked on top of each other in the up-down direction. Each of the channel plates may be formed having part of each pressure chamber, part of each first throttle channel, and part of each second throttle channel.

Figure 8:
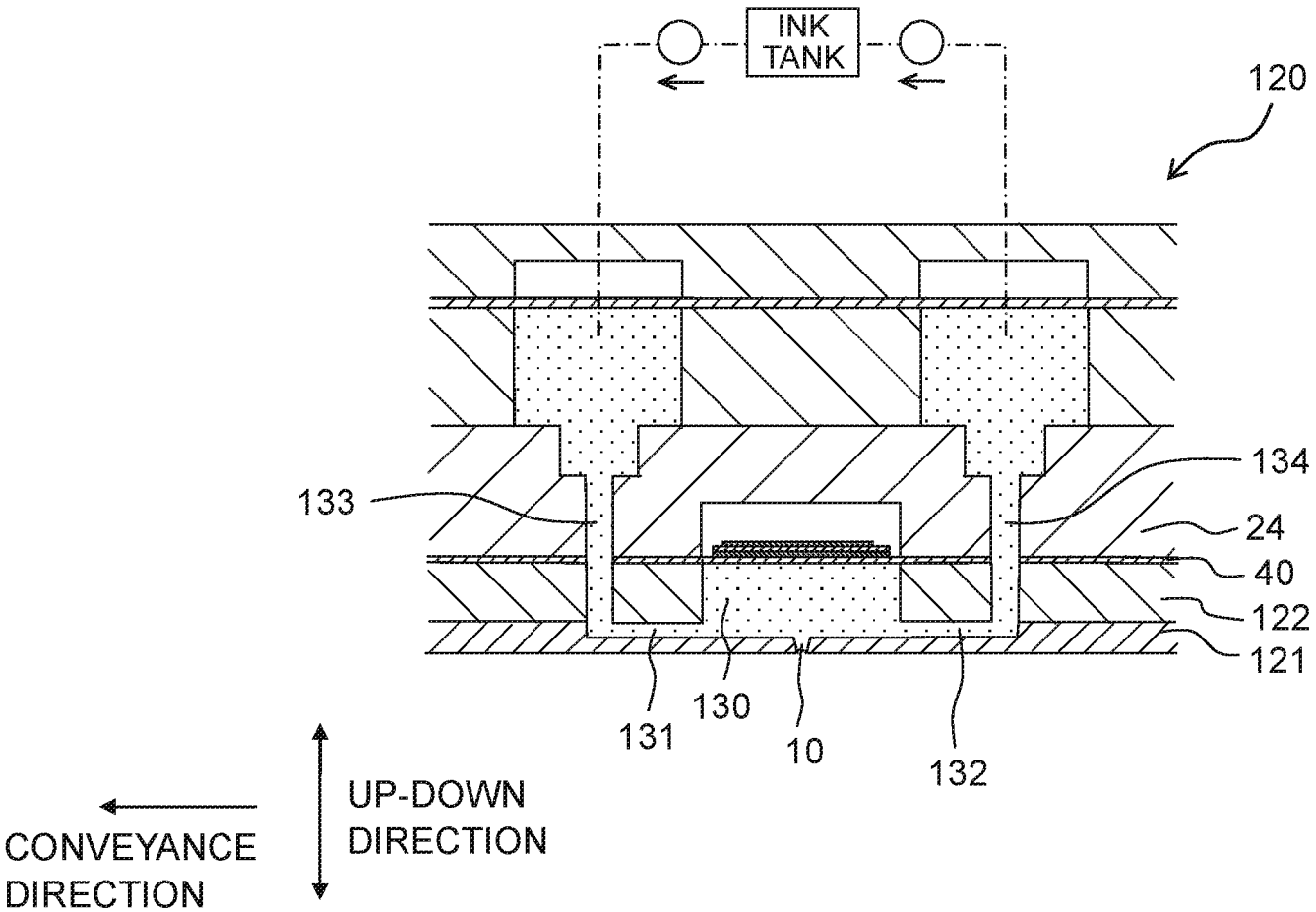
FIG. 8 is a cross-sectional view of a head unit according to a third modified example, wherein the cross-sectional view corresponds to FIG. 3.

In a third modified example, a head unit 120 includes a nozzle plate 121 and a channel substrate 122, as depicted in FIG. 8. The pressure chamber 130 extends over the channel substrate 122 and an upper portion of the nozzle plate 121, and the nozzle 10 is formed at a lower portion of the nozzle plate 121. A first throttle channel 131 and a second throttle channel 132 are formed at the upper portion of the nozzle plate 121 and they are connected to end portions in the conveyance direction of the pressure chamber 130 that are positioned at the lower side. Corresponding to this configuration, a first connection channel 133 and a second connection channel 134 extend in the up-down direction over the entirety of the protection substrate 24, the entirety of the vibration film 40, and the entirety of the channel substrate 122, and the upper portion of the nozzle plate 121.

In the third modified example, the nozzle plate 121 is formed having the lower end portion of the pressure chamber 130, the first throttle channel 131, and the second throttle channel 132. Thus, the flow of ink through the pressure chamber 130 from the first throttle channel 131 to the second throttle channel 132 is generated at the lower end portion of the pressure chamber 130 formed in the nozzle plate 121. The flow of ink inhibits drying of ink in the nozzle 10. Further, in the third modified example, the pressure chamber 130 extends over the channel substrate 122 and the nozzle plate 121, making the volume of the pressure chamber 130 larger than a case in which the pressure chamber is formed only in the channel substrate 122.

In the third modified example, the entirety of the first throttle channel 131 and the entirety of the second throttle channel 132 are formed in the nozzle plate 121. The present disclosure, however, is not limited thereto. For example, in the third modified example, the channel substrate 122 may be formed having an upper half portion of the first throttle channel and an upper half portion of the second throttle channel, and the nozzle plate 121 may be formed having a lower half portion of the first throttle channel and a lower half portion of the second throttle channel Namely, the first throttle channel and the second throttle channel may extend over the nozzle plate 121 and the channel substrate 122.

In the above embodiment, the channel resistance of the first throttle channel 31 is the same as the channel resistance of the second throttle channel 32. The present disclosure, however, is not limited thereto. For example, at least one of the length in the sheet width direction, the length in the conveyance direction, and the length in the up-down direction may be different between the first throttle channel 31 and the second throttle channel 32, which may make the channel resistance of the first throttle channel 31 different from the channel resistance of the second throttle channel 32. Namely, the difference between the channel resistance of the first throttle channel 31 and the channel resistance of the second throttle channel 32 may exceed 5%.

In the above embodiment, the shape of each of the first throttle channel 31 and the second throttle channel 32 as viewed in the conveyance direction is the rectangle. The present disclosure, however, is not limited thereto. The shape of the first throttle channel as viewed in the conveyance direction may be any other polygon than the rectangle in which the length in the sheet width direction is longer than the length in the up-down direction or an oval of which longitudinal direction is parallel to the sheet width direction. Or, the shape of the second throttle channel as viewed in the conveyance direction may be any other polygon than the rectangle in which the length in the sheet width direction is longer than the length in the up-down direction or an oval of which longitudinal direction is parallel to the sheet width direction. Or, the both shapes of the first throttle channel and the second throttle channel as viewed in the conveyance direction may be any other polygons than the rectangles in which the length in the sheet width direction is longer than the length in the up-down direction or ovals of which longitudinal direction is parallel to the sheet width direction.

In the above embodiment, the length W1 in the sheet width direction of the first throttle channel 31 is 2.6 times or more and 4.3 times or less of the length H1 in the up-down direction. The length W2 in the sheet width direction of the second throttle channel 32 is 2.6 times or more and 4.3 times or less of the length H2 in the up-down direction. The present disclosure, however, is not limited thereto.

The length W1 in the sheet width direction of the first throttle channel 31 may be twice or more and less than 2.6 times of the length H1 in the up-down direction, or may be longer than 4.3 times of the length H1 in the up-down direction. The length W2 in the sheet width direction of the second throttle channel 32 may be twice or more and less than 2.6 times of the length H2 in the up-down direction, or may be longer than 4.3 times of the length H2 in the up-down direction. Also in those cases, it is possible to make the channel resistance per unit length of each of the first throttle channel 31 and the second throttle channel 32 sufficiently large.

The length W1 in the sheet width direction of the first throttle channel 31 may be less than twice the length H1 in the up-down direction of the first throttle channel 31, provided that the length W1 is longer than the length H1. The length W2 in the sheet width direction of the second throttle channel 32 may be less than twice the length H2 in the up-down direction of the second throttle channel 32, provided that the length W2 is longer than the length H2.

In the above embodiment and examples, ink circulates between the head unit and the ink tank. The present disclosure, however, is not limited thereto. For example, in the above embodiment, ink in the ink tank 65 may be supplied to the pressure chambers 30 via the first manifold 61, the first connection channels 57, and the first throttle channels 31 by reversing the ink flowing direction by the second pump 67 and feeding ink by the first pump 66. Further, ink in the ink tank 65 may be supplied to the pressure chambers 30 via the second manifold 62, the second connection channels 58, and the second throttle channels 32 by feeding ink by the second pump 67.

The examples in which the present disclosure is applied to the ink-jet head discharging ink from nozzles are described above. The present disclosure, however, is not limited thereto. The present disclosure is applicable to a liquid discharge head discharging any other liquid than ink, such as liquefied resin and liquefied metal, from nozzles.

What is claimed is:

1. A liquid discharge head, comprising:

a pressure chamber;

a nozzle connected to the pressure chamber and overlapping in a first direction with the pressure chamber;

a first throttle channel connected to an end at a first side in a second direction, which is orthogonal to the first direction, of the pressure chamber and extending in the second direction;

a second throttle channel connected to an end at a second side in the second direction of the pressure chamber and extending in the second direction; and a channel substrate in which the pressure chamber is formed, wherein the first throttle channel passes through a first portion of the channel substrate and the second throttle channel passes through a second portion of the channel substrate, wherein in each of the first throttle channel and the second throttle channel, a length in a third direction orthogonal to the first direction and the second direction is longer than a length in the first direction, and wherein in each of the first throttle channel and the second throttle channel, the length in the third direction is 2.6 times or more and 4.3 times or less of the length in the first direction.

2. The liquid discharge head according to claim 1, wherein a shape of each of the first throttle channel and the second throttle channel as viewed in the second direction is a rectangle that is long in the third direction.

3. The liquid discharge head according to claim 1, wherein the first direction is a vertical direction, the first throttle channel is a channel through which liquid flows into the pressure chamber, the second throttle channel is a channel through which the liquid flows out of the pressure chamber, the second throttle channel is shorter in the first direction than the pressure chamber, and the second throttle channel is connected to an upper end of the end at the second side in the second direction of the pressure chamber.

4. The liquid discharge head according to claim 3, wherein the first throttle channel is shorter in the first direction than the pressure chamber, and the first throttle channel is connected to an upper end of the end at the first side in the second direction of the pressure chamber.

5. The liquid discharge head according to claim 3, wherein the first throttle channel is shorter in the first direction than the pressure chamber, and the first throttle channel is connected to a lower end of the end at the first side in the second direction of the pressure chamber.

6. The liquid discharge head according to claim 1, wherein the first direction is a vertical direction, the liquid discharge head further comprises a first connection channel and a second connection channel extending in the vertical direction, a lower end of the first connection channel is connected to an end at the first side in the second direction of the first throttle channel, and a lower end of the second connection channel is connected to an end at the second side in the second direction of the second throttle channel.

7. The liquid discharge head according to claim 1, wherein the first throttle channel is a channel through which liquid flows into the pressure chamber, the second throttle channel is a channel through which the liquid flows out of the pressure chamber, and the length in the first direction and the length in the third direction of the second throttle channel are respectively constant independent of a position in the second direction.

8. The liquid discharge head according to claim 7, wherein the length in the first direction and the length in the third direction of the first throttle channel are respectively constant independent of a position in the second direction.

9. The liquid discharge head according to claim 1, wherein the first throttle channel and the second throttle channel are shorter in the third direction than the pressure chamber.

10. The liquid discharge head according to claim 9, wherein the pressure chamber is included in a plurality of pressure chambers aligned in the third direction, the nozzle is included in a plurality of nozzles respectively connected to the pressure chambers, the first throttle channel is included in a plurality of first throttle channels respectively connected to the pressure chambers, and the second throttle channel is included in a plurality of second throttle channels respectively connected to the pressure chambers.

11. The liquid discharge head according to claim 9, wherein each of the first throttle channels is a channel through which liquid flows into one of the pressure chambers, each of the first throttle channels is connected to a center portion in the third direction of the end at the first side in the second direction of one of the pressure chambers, each of the second throttle channels is a channel through which the liquid flows out of one of the pressure chambers, and each of the second throttle channels is connected to a center portion in the third direction of the end at the second side in the second direction of one of the pressure chambers.

12. The liquid discharge head according to claim 11, wherein each of the pressure chambers has inner wall surfaces facing the third direction, each of the second throttle channels has inner wall surfaces facing the third direction, portions at the second side in the second direction of the inner wall surfaces of each of the pressure chambers are respectively connected to the inner wall surfaces of one of the second throttle channels, and the portions at the second side in the second direction of the inner wall surfaces of each of the pressure chambers are inclined to the second direction toward the center portion in the third direction of one of the pressure chambers, as the portions at the second side in the second direction of the inner wall surfaces of the pressure chamber are farther away from a center portion in the second direction of the pressure chamber.

13. The liquid discharge head according to claim 1, wherein the pressure chamber, the first throttle channel, and the second throttle channel are formed in one channel plate.

14. The liquid discharge head according to claim 1, wherein a channel resistance of the first throttle channel is identical to a channel resistance of the second throttle channel.

15. The liquid discharge head according to claim 6, further comprising a protection substrate formed above the channel substrate in the vertical direction, and wherein the first connection channel passes through a first portion of the protection substrate and the second connection channel passes through a second portion of the protection substrate.

16. The liquid discharge head according to claim 1, further comprising:

a protection substrate formed above the channel substrate in a vertical direction, wherein the first direction is the vertical direction;

a manifold member, wherein the manifold member is formed vertically above the protection substrate;

a first manifold formed in the manifold member; and a second manifold formed in the manifold member.

17. The liquid discharge head according to claim 16, further comprising:

an upper end of the first connection channel connected to an end at a first side in the first direction of the first manifold, and an upper end of the second connection channel connected to an end at a first side in the first direction of the second manifold.

18. The liquid discharge head according to claim 16, further comprising a first damper film disposed on an upper surface of the first manifold member.

* * * * *